United States Patent [19]

Einan et al.

[11] 4,200,140

[45] Apr. 29, 1980

[54] METHOD FOR TEEM-WELDING METALS

[75] Inventors: Gerhard Einan; Arne Gruben; Erling Klungseth; Ingar Magnussen; Olav O. Moen; Per Vee, all of Øvre Årdal; Kai M. Vik, Haslum, all of Norway

[73] Assignee: Ardal og Sunndal Verk a.s., Oslo, Norway

[21] Appl. No.: 849,518

[22] Filed: Nov. 7, 1977

[51] Int. Cl.[2] ..... B22D 19/04

[52] U.S. Cl. ..... 164/105; 164/108; 164/332; 219/72; 228/240; 228/260

[58] Field of Search ..... 219/72; 228/256, 260, 228/261, 239, 240, 241; 164/106, 108, 337, 105, 332

[56] References Cited

U.S. PATENT DOCUMENTS

| | | | |
|---|---|---|---|
| 1,782,447 | 11/1930 | Scrantom | 164/106 |
| 2,191,482 | 2/1940 | Hopkins | 164/108 X |
| 2,226,695 | 12/1940 | Chace | 164/108 X |
| 2,264,003 | 11/1941 | Osenberg | 164/108 X |
| 2,395,723 | 2/1946 | Chmielewski | 228/244 X |
| 2,904,863 | 9/1959 | Schmid | 164/136 X |
| 3,100,338 | 8/1963 | Henry | 228/256 X |
| 3,171,013 | 2/1965 | Danhier | 228/256 X |
| 3,459,346 | 8/1969 | Tinnes | 164/337 X |
| 3,608,617 | 9/1971 | Burke | 164/337 X |
| 3,608,621 | 9/1971 | Bollig | 164/337 X |
| 3,860,062 | 1/1975 | McMurray | 164/108 X |
| 4,063,677 | 12/1977 | Bergmann | 228/256 X |

FOREIGN PATENT DOCUMENTS

| | | | |
|---|---|---|---|
| 302769 | 12/1915 | Fed. Rep. of Germany | 164/136 |
| 49-28807 | 7/1974 | Japan | 164/337 |

*Primary Examiner*—Richard R. Kucia

*Attorney, Agent, or Firm*—Wenderoth, Lind & Ponack

[57] ABSTRACT

A method is provided for teem-welding metals, preferably light metals, particularly aluminium and its alloys, in which the metal, during its introduction into a casting mould, is caused to form one or more metal jets which are directed as far as possible at right-angles to and concentrated against the surfaces to be melted of the workpiece or workpieces. There is used a mould of such volume and with such an arrangement of the workpiece or workpieces therein, that the desired melting is achieved with that quantity of metal which, as the process proceeds, accumulates in and fills the mould, which quantity constitutes all the metal introduced into the mould.

17 Claims, 4 Drawing Figures

METHOD FOR TEEM-WELDING METALS

BACKGROUND OF THE INVENTION

This invention relates to a method for teem-welding metals, preferably light metals, particularly aluminium and its alloys. The invention further relates to a nozzle arrangement for use in an embodiment of the method.

In certain industries, for example in the electrolytic smelting of aluminium, the series welding of workpieces of comparatively large dimensions is an important cost factor. Of particular interest in this connection is the joining of busbars, cables or flexible electric conductors of large cross-section to carry the high currents which are used in electrolytic smelting.

A method previously in common use for such teem-welding is the through-flow method, in which the molten metal which is used for the teem-welding process, is caused to flow through the casting mould long enough to achieve the desired melting of the workpiece or workpieces. This method required a very much larger quantity of metal than that needed for the actual weld. For this reason, the method is laborious in practice, and further, costly on account of the large volume of metal which has to be melted and handled, including its transportation before and after the making of the teem-weld. In spite of this, teem-welding by the through-flow method has been very widely used for the purposes under discussion herein.

A second well-known method which should also be mentioned, is the so-called thermit welding method. This is an exothermic welding process, and is based on the fact that the metal is melted by means of the reaction heat which is developed on the ignition of a special welding powder mixture. A highly overheated melt results and is introduced into the casting mould which is usually made of graphite, and which surrounds the ends of the workpieces which are to be joined together. This method is used, for example, for joining railway lines etc., but is fairly expensive on account of the special powder mixture used.

SUMMARY OF THE INVENTION

The disadvantages of the above-mentioned and of other well-known methods of teem-welding are avoided by the present invention, in that the metal, on being introduced into the casting mould, is caused to form one or more jets of metal which are directed as far as possible at right-angles to and concentrated against the surfaces of the workpiece(s) to be melted, and in that use is made of a casting mould of such volume and with the workpiece(s) so arranged therein that the desired melting of the workpiece or workpieces is achieved with the quantity of metal which, as the process proceeds, accumulates in and fills the mould.

The new method makes it thus possible to perform teem-welding without a large quantity of excess molten metal, in that the amount of metal which is required for the finished product is, in essence, sufficient to achieve the necessary melting of the workpiece(s). Practical trials have shown that this can be achieved without such very high overheating of the molten metal as, for example, is required by the thermit welding method.

The principle of the method disclosed herein is that it produces a local shock heating of the workpiece by directing a metal jet with adequate overtemperature straight against the appropriate, and possibly pre-cleaned, surfaces of the workpiece so that, in the course of a very short time, a local melting occurs where the metal jet strikes the workpiece.

As mentioned above, almost all of the molten metal supplied is utilized, and can be shaped in a mould to form, for example, joining fittings, or be used to fill the seam or space between two rail ends or plate ends to be joined.

A practical device for performing the method described herein is a nozzle arrangement which, according to the invention, comprises a filling funnel with room for at least a part of the total volume of metal which is to be introduced into the casting mould, and one or more down tubes extending from the bottom part of the filling funnel, each equipped with one or more nozzles, by means of which each will direct a jet of metal against the workpiece(s), which down tubes, together with the filling funnel, are so dimensioned as to give the metal the requisite head during the introduction into the casting mould, and which down tube(s) and nozzle(s) are made of materials which allow them to be flooded by the metal which, as the process proceeds, accumulates in the mould.

The idea of basing the process on a nozzle arrangement which becomes partly flooded by the molten metal in the casting mould is one which will seem foreign to those versed in casting technology, but it forms a surprising and advantageous feature in the carrying out of the method according to the invention in one of its aspects.

Compared with the through-flow method, this invention offers simplification and saving in that the flowing through of the molten metal has been abandoned. Corresponding advantages are also achieved in that the pre-heating of the basic material in the workpiece(s) can be eliminated. Finally, it is an advantage that the overtemperature to which the molten metal is brought is such as already exists in practice in metal foundries and casting shops, particularly aluminium casting shops, (700°–900° C.).

The overtemperature in the case of aluminium is thus about 50°–200° C. above the melting point. Too high overtemperatures, however, are undesired, since the intention is only to melt the metal in the workpiece immediately behind the oxide film, which floats up to the surface of the molten metal. This fact makes it unnecessary to clean aluminium rails or busbars before welding, which is surprising and reduces expenses.

Thus, in practice the welding surfaces may only have to be treated for removal of oil or grease with a suitable solvent and the temperature of the molten metal used can be kept very low, in particular when some pre-heating of the welding surface on the workpiece is carried out. In such case the combined or added temperature of the molten metal and the welding surface pre-heating temperature, is the significant parameter, and the sum of these combined temperatures shall not be lower than 950° C. for pure aluminium.

The teem-welding method contemplated here leads to a characteristic transition zone between the workpiece material and the metal in the cast joint. This is something quite different from what is found when using known welding methods.

The use of a nozzle arrangement with a filling funnel and extended down tubes makes it possible to solve more demanding teem-welding tasks in which it is a question of making the best possible use of the heat energy content in the amount of molten metal at disposal. Through optimizing the process, it is possible to achieve conditions which make fewer demands on the degree of overtemperature of the molten metal. In general, the best possible utilization of the molten metal means that the conducting away of heat to parts of the workpiece(s) which are not to be melted, should be small. Important factors in this connection are briefly as follows:

1. The melting should be rapid so that the heat dissipation is small.

So that the molten metal in the mould shall end up with the least possible overtemperature, which has to be reduced by the heating up of the mould itself and by normal dissipation to the surroundings, it is important that:

2. The hot metal is directed against the workpiece surface or surfaces which is (are) to be melted, and
3. The heat transfer figure should be the best possible. This means high relative speed between the flow of molten metal and the workpiece. This gives a high heat transfer per unit of area.

Melting the greatest possible amount of the material in the desired surface areas of the workpiece means that:

4. The high effect achieved according to item three above should last as long as possible.

The factors under items one and four above may seem contradictory, but by taking steps to bring the heat transfer figure under item three to the highest possible value, it will in practice be possible to come down to a sufficiently short time. The advantage which is possible in respect of the factor in item one has a diminishing effect. Expressed in popular and simplified terms: if the melting occurs more rapidly along the workpiece than the speed at which the heat travels, the conduction away of heat is no longer of significance.

The directed metal jet(s) in accordance with item two above, is (are) produced by using the above-mentioned puzzle arrangement.

Also, item three above is closely linked with the use of the above-mentioned nozzle arrangement. A high heat transfer figure is achieved by arranging small nozzle orifices near the surface which is to be heated up and melted.

In order to cover the whole of the surface in question of the workpiece, it may be necessary to arrange several nozzles, or the nozzle or nozzles can be caused to move during the casting process. When using small nozzle orifices, it is particularly important that the molten metal is under sufficient pressure. This is achieved by filling the filling funnel rapidly with molten metal, forming a high head between the surface of the molten metal in the funnel and the nozzle orifices, or the surface of the metal in the mould as this fills up. The filling funnel and down tube(s) must therefore be so designed as to enable the necessary head to be established.

In practically all cases, when performing the method according to the invention, it will be necessary to preheat the nozzle arrangement in order to avoid the freezing of the metal therein and unnecessary heat loss from the molten metal.

More particularly, it is of great importance in practice that the metal jet or jets be directed against the workpiece at right-angles with good impact force, i.e. with sufficient head in the filling funnel, and with the nozzle orifice(s) as near to the workpiece as possible, i.e. less than 50 mm in the case of aluminium.

In the foregoing, importance is attached to the fact that the filling time should not be too short. More specifically, it is the amount of metal added per unit of time which is decisive. It is this input of metal which also supplies the necessary heat for the melting, which has to be supplied in the appropriate quantity as explained above.

While the nozzle arrangement usually needs preheating, the same does not necessarily apply to the workpiece(s), nor to the mould. These parts normally require heating up only sufficiently to drive off any moisture that may be present.

BRIEF DESCRIPTION OF THE DRAWINGS

The invention will be described below in more detail with reference to the drawings, in which.

DETAILED DESCRIPTION OF THE INVENTION

Figure 2:
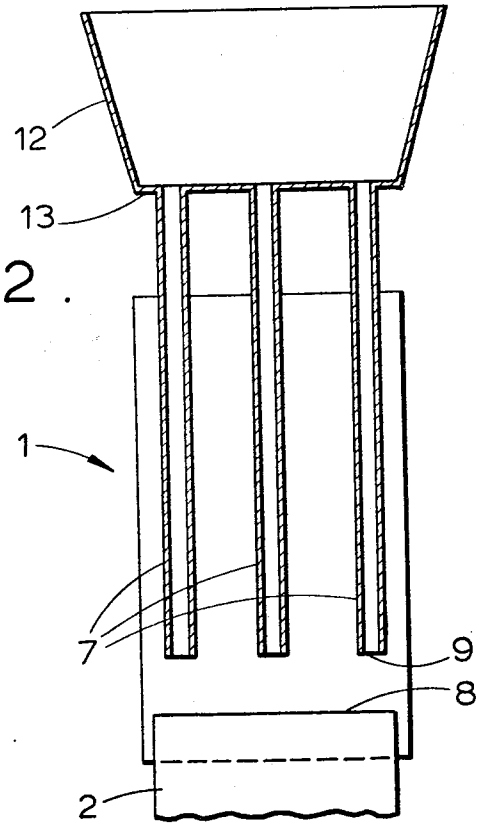
FIG. 2 illustrates the same arrangement as FIG. 1, but seen from the side.
Figure 1:
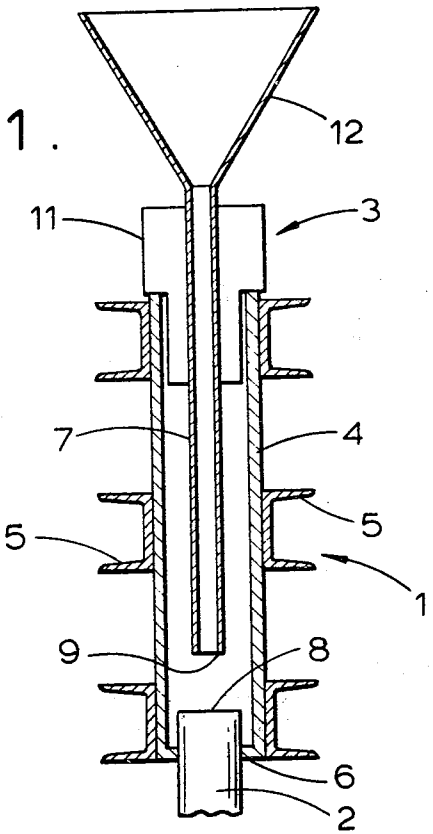
FIG. 1 shows a vertical section through an arrangement for teem-welding a contact piece onto flexible electric conductors.

In FIGS. 1 and 2 there is shown a mould 1 through the bottom 6 of which there has been inserted a group or pack 2 of flexible electric conductors, for example, of aluminium. The mould 1 has vertical walls 4 and reinforcing frames 5. In this mould 1 there is inserted a nozzle arrangement 3 consisting of a filling funnel 12 in the bottom part 13 of which there are disposed down tubes 7 which are of such a length that nozzles 9 at the lower ends of the tubes are positioned directly opposite and at a short distance from the top surface 8 of the flexible conductors 2. For guiding the nozzle arrangement 3 into the mould 1, the nozzle arrangement is fitted with a guide 11 in the form of welded-on plates so arranged as to co-ordinate with the inside and the top respectively of the mould walls 4. The nozzle arrangement can be equipped with devices for lifting and manipulating, either by crane or by hand.

The flexible conductors 2 must protrude sufficiently over the bottom 6 of the mould 1 to enable the necessary melting for the welding operation to take place. It may be seen from FIGS. 1 and 2 that the metal jets from the nozzles 9 will strike the surface 8 at right-angles, thus providing the best possible heat transfer.

The normal procedure for performing a teem-weld with the arrangement in FIGS. 1 and 2, is briefly as follows:

The flexible conductors 2 are cleaned and fitted into mould 1. The nozzle arrangement 3 is pre-heated in a small oven suitable for the purpose. Mould 1, with flexible conductors 2, is heated up in order to drive off any moisture that may be present. When the nozzle arrangement 3 has reached a sufficiently high temperature through the pre-heating, it is placed in mould 1 as shown in FIGS. 1 and 2. Then, the molten metal, which has been heated up to a suitable overtemperature, is poured rapidly into the funnel 12 and topped up in the funnel so that the surface of the metal is maintained at a suitable height in the funnel which gives a pressure head necessary to produce jets of metal from nozzles 9 with sufficient intensity to melt surface 8 to the extent required. While this is going on, the metal will rise up in mould 1 so that the down tubes 7 will become partly submerged in the metal which accumulates in mould 1. When the required quantity of metal has been poured into mould 1, the nozzle arrangement 3 is lifted out of the mould 1.

The metal is allowed to solidify in the mould, and the workpiece is then removed and, in the event necessary, machined, this machining including the cutting off of the pipes at the upper end.

It is clear that the process described herein can be modified, for example, the nozzle arrangement 3 can be partly lifted up in mould 1 when the desired melting of surface 8 has taken place. The remaining amount of metal to be filled into the mould will not contribute in any degree worth mentioning to further melting. Also, the actual design of the nozzle arrangement can be different. For example, instead of three separate down tubes 7 there can be a common down channel at the lower end of which the necessary number of nozzles are disposed.

Figure 4:
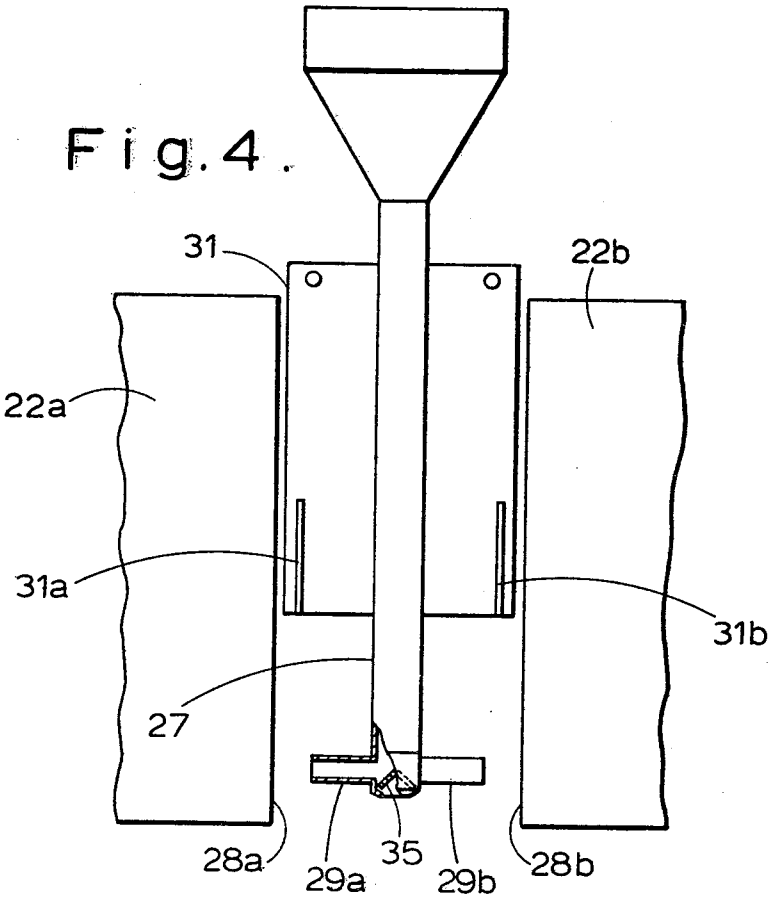
FIG. 4 portrays the nozzle arrangement in FIG. 3, in position between two rail or plate ends, ready for starting a teem-welding operation.
Figure 3:
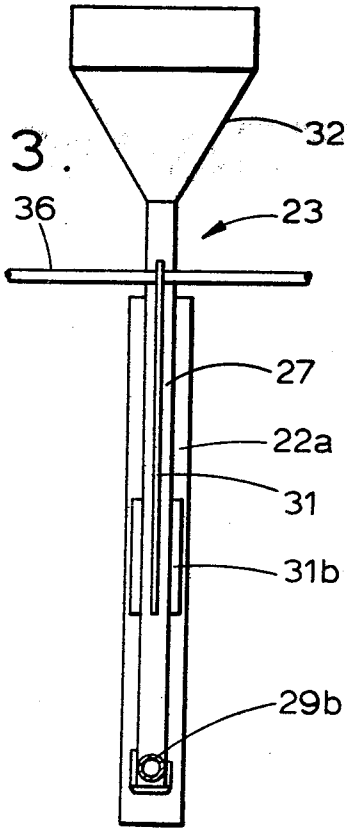
FIG. 3 depicts a nozzle arrangement for use when joining rails or plates.

The nozzle arrangement shown in FIGS. 3 and 4 is intended for stepwise or continuous movement upwards during the teem-welding process. The whole nozzle arrangement unit in these figures is referenced 23, and consists of a filling funnel 32 with a down tube 27 carrying two nozzles 29*a* and 29*b* pointing horizontally in separate directions from the lower end of the down tube 27. As may be clearly seen from FIG. 4, there is disposed, at the bottom of the down tube 27, a separating device in the form of an angle iron 35 positioned symmetrically in the tube 27 between nozzles 29*a* and 29*b*.

As may be clearly seen from FIG. 4, nozzle arrangement 23 has been positioned between the ends 28*a* and 28*b* of two rail-shaped or plate-shaped workpieces 22*a* and 22*b*. These plates or rails can be fairly thick compared with the nozzle arrangement as may be seen from FIG. 3. The nozzle arrangement has flat guides 31, 31*a* and 31*b*, arranged to cooperate with the end surfaces 28*a* and 28*b* respectively, and the mould wall (not shown). To facilitate manipulation, the nozzle arrangement 23 is fitted with a lifting handle or the like 36.

The nozzle arrangement 23 is shown in the figure at almost its lowest position in relation to the two workpiece surfaces 28*a* and 28*b*, the teem-welding operation being in the case intended to be performed with a continuous or stepwise movement of the nozzle arrangement upwards through the mould while the molten metal is being poured into the mould. This upward movement of the nozzle arrangement is made to suit the degree of melting required of the end surfaces 28*a* and 28*b*.

The embodiment of the nozzle arrangement shown in FIGS. 3 and 4 according to the invention has two nozzles, but it is clear that the number of nozzles can be adapted to suit the size and shape of the workpieces, and also to allow a possible pattern of movement of the nozzle arrangement during the casting operation. For example, cases can be envisaged in which, instead of or in addition to a vertical movement of the nozzle arrangement, there be also described a horizontal movement in order to be able to cover the surfaces of the workpiece(s) in question in an expedient manner.

The essential feature of all these variants is that each surface area which it is wished to melt of the workpiece in question, shall be acted on by one or more jet(s) of metal long enough to achieve the degree of melting desired. In this connection, it is a presupposition that essentially all the quantity of metal used forms a part of the finished workpiece or casting. This can in practice, when joining two workpieces, be achieved in that the seam or the space between these be adjusted in order to be able to accept the desired volume of metal as, for example, shown in FIG. 4.

It is not necessary that the molten metal consist of the same metal or alloy as the workpiece or workpieces. For anyone skilled in the art it will be clear that any basic material which can be melted and which can, in solid and liquid phase, be mixed with the molten metal, shall, in principle, be able to be welded or joined by means of the method disclosed herein. This refers also to metals and alloys other than aluminium, which is the metal primarily discussed above. The method is, in principle, applicable to all kinds of welds. For example, the joining of two plates by a conventional V weld or X weld, could be replaced by welding according to the method disclosed herein. In such cases, it may be necessary to modify the mould used to enable it to function as a sliding or rolling shuttering. The question may also arise of using inert gas should this be found expedient to protect the metal against oxidation during the welding process. With respect to the application of the special nozzle arrangement herein described, it shall be mentioned that the necessary speed of the jet or jets of metal can also be achieved if the metal is allowed to fall comparatively freely through the appertaining down tubes.

As a further advantage of the method according to the invention is the possibility that cores for making holes for bolts etc. can be placed in the mould before the metal is poured in, thus reducing the subsequent machining of the workpiece.

We claim:

1. A method for teem-welding metal members, particularly members formed of light metals such as aluminum and alloys thereof, said method comprising:

providing a casting mold;

extending at least two workpieces into said casting mold such that at least one surface to be melted of each said workpiece is exposed within the interior of said casting mold;

providing a nozzle arrangement having at least one nozzle opening, and positioning said nozzle arrangement such that said nozzle opening is within said interior of said casting mole and directed substantially at a right angle to and closely adjacent said surfaces to be melted of said workpieces;

injecting molten metal through said nozzle arrangement and said nozzle opening at a pressure sufficient to form at least one jet of molten metal which is directed at a right angle to and concentrated against said surfaces to be melted, and thereby melting said surfaces and the adjacent portions of said workpieces;

continuing injection said molten metal until said casting mold is filled with said molten metal and the melted portions of said workpieces, while maintaining said nozzle opening within said interior of said casting mold such that said nozzle opening becomes immersed in said molten metal and said nozzle arrangement becomes at least partly flooded by said molten metal;

preheating said nozzle arrangement prior to said step of injecting; and providing said casting mold with such a volume and positioning said workpieces with respect to said casting mold such that during said steps of injecting and continuing injecting a desired degree of melting of said workpieces is achieved with that quantity of said molten metal, all of which, as the process proceeds, accumulates in and fills said casting mold.

2. A method as claimed in claim 1, further comprising arranging said workpieces with respect to said casting mold such that said interior of said casting mold does not extend vertically downwardly below said workpieces.

3. A method as claimed in claim 1, further comprising, prior to said step of injecting, preheating said workpieces to a temperature just sufficient to vaporize any moisture on said surface to be melted.

4. A method as claimed in claim 1, further comprising, immediately prior to said step of injecting, maintaining said workpieces at room temperature.

5. A method as claimed in claim 1, wherein said step of preheating comprises preheating said nozzle arrangement to a temperature higher than the melting point of said molten metal.

6. A method as claimed in claim 1, wherein said workpieces are aluminum, and said nozzle opening is positioned approximately 50 mm from said surface to be melted.

7. A method as claimed in claim 1, wherein said jet of molten metal is maintained in substantially the same position within said interior of said casting mold during the injection of the entire said quantity of said molten metal.

8. A method as claimed in claim 1, further comprising, during the injection of said molten metal, moving said nozzle opening and causing said jet of molten metal to successively strike against and melt successive portions of said surfaces to be melted.

9. A method as claimed in claim 8, comprising moving said nozzle opening continuously during said injection.

10. A method as claimed in claim 8, comprising moving said nozzle opening stepwise during said injection.

11. A method as claimed in claim 1, further comprising, prior to said step of injecting, preheating said molten metal to an over-temperature substantially above the melting point of said molten metal.

12. A method as claimed in claim 11, wherein said molten metal comprises aluminum, and said over-temperature is from 50° to 200° C. above said melting point.

13. A method as claimed in claim 1, for casting a piece on ends of elongated plural workpieces, comprising protruding said ends of said workpieces into said casting mole through the bottom thereof, by a length amount greater than the length of said portions to be melted, positioning said surfaces to be melted to face substantially vertically upwardly, and positioning said nozzle opening to extend substantially vertically downwardly.

14. A method as claimed in claim 1, for joining two plate-shaped or rail-shaped workpieces end to end, comprising protruding ends of said two workpieces into said interior of said casting mold from separate sides thereof, with said ends having surfaces which extend substantially vertically and which confront each other and are spaced from each other by a space sufficient for the necessary volume of said quantity of molten metal, and wherein said injecting comprises directing at least two jets of molten metal substantially horizontally against said surfaces.

15. A method as claimed in claim 14, wherein said nozzle arrangement includes two horizontally extending, oppositely directed nozzle openings of a size sufficient to cover only a small portion of the vertical height of said surfaces, and further comprising, during the injection of said molten metal, moving said nozzle openings vertically upwardly through said interior of said casting mold and causing said jets of molten metal to successively strike against and melt successive vertical portions of said surfaces.

16. A method as claimed in claim 15, comprising moving said nozzle openings continuously during said injection.

17. A method as claimed in claim 15, comprising moving said nozzle openings stepwise during said injection.

* * * * *